United States Patent [19]

Loring

[11] Patent Number: 4,544,987

[45] Date of Patent: Oct. 1, 1985

[54] MAGNETICALLY OPERATED AC SWITCHING DEVICE WITH DELAY-ON-DROPOUT

[75] Inventor: Dennis J. Loring, Pawtucket, R.I.

[73] Assignee: Elmwood Sensors, Inc., Pawtucket, R.I.

[21] Appl. No.: 533,153

[22] Filed: Sep. 19, 1983

[51] Int. Cl.[4] ..... H01H 47/32

[52] U.S. Cl. ..... 361/194; 335/254

[58] Field of Search ..... 361/194; 335/254

[56] References Cited

U.S. PATENT DOCUMENTS 2,410,183 10/1946 Ray ..... 361/194 X 2,481,431 9/1949 Logan ..... 361/194

*Primary Examiner*—Reinhard J. Eisenzopf

*Attorney, Agent, or Firm*—Salter & Michaelson

[57] ABSTRACT

A magnetically operated AC switching device, such as an AC electrical contactor, is operable with a delay-on-dropout feature to permit safe shutdown of equipment energized therethrough in case of power failure. The device includes an AC pickup winding which is energizable from an AC power source and a DC holding winding which is electrically connected to a rectifier for energization of the holding winding with DC power from the AC source. A capacitor is also electrically connected to the rectifier in parallel with the holding winding for energization with DC power from the AC source. Upon energization of the device, the AC pickup winding moves fixed and movable contacts of the device into engagement, and the DC holding winding maintains them in engagement. The AC pickup winding can remain energized without burnout; and upon power dropout the capacitor supplies DC power to the holding winding for an instant to provide a slight delay in the separation of the contacts.

6 Claims, 3 Drawing Figures

MAGNETICALLY OPERATED AC SWITCHING DEVICE WITH DELAY-ON-DROPOUT

BACKGROUND AND SUMMARY OF THE INVENTION

The instant invention relates to a magnetically operated AC switching device, such as an AC contactor, and more particularly to an AC device which exhibits slight delay characteristics on dropout.

It has been found that for some electrical switching applications in the computer industry and in other industries, slight delay characteristics on dropout are desirable. More specifically, it has been found that for some applications it is desirable for a contactor to be operable to maintain a circuit in an electrically connected or closed condition for an instant after the electrical power to the contactor has been interrupted or shut off. In the computer industry a delay feature of this type is desirable for some contactor applications in order to permit safe shutdown of equipment energized through contactors in cases of power failure or serious "brownout" conditions. In this regard, a slight delay-on-dropout provides ample time to permit a safe shutdown of computer equipment without resulting in the loss of information and programming stored in memory, whereas without this feature data stored in the computer memory can be permanently lost.

Heretofore, DC contactors having delay features have been available and have sometimes been used in the above-described applications where delay features have been required. The heretofore known DC contactors have comprised separate DC pickup and holding windings, the pickup windings being of substantially greater strength than the holding windings and being operable for closing the contacts of the contactors, and the holding windings being operable for maintaining the contacts in the closed positions thereof. Contactors of this type have further comprised capacitors electrically connected in parallel across the holding windings thereof to provide the necessary delay features and have included switches for deenergizing the pickup windings thereof once the respective contacts of the contactors are in engagement to prevent burnout of the pickup windings, which draw substantial amounts of current. Unfortunately, however, the mechanical malfunction potential of the DC pickup winding switches has been a major drawback in contactors of this type and has frequently resulted in pickup winding burnout.

AC contactors have generally proven to be more reliable than DC contactors; however, AC contactors with effective delay-on-dropout characteristics have heretofore been unavailable. While attempts have been made to provide delay characteristics by mechanically delaying the opening of the contacts in AC contactors with dash pots or the like, the use of such mechanical devices has been ineffective. Specifically, mechanical delay components of this type have merely functioned to slow the movement of the contacts of the contactors and have therefore resulted in undesirable contact arcing. What is actually desired in this regard is a delay feature which initially delays the movement of contacts without thereafter impeding the movement of the contacts.

The reason that AC contactors in general are more reliable than DC contactors is that they do not require mechanical switching components in order to prevent pickup winding burnout. In this regard, when an AC contactor is energized, it initially draws a relatively large "inrush" current which creates a large magnetic field, whereby the armature of the contactor is magnetically attracted to the magnet thereof to close the contacts of the contactor. However, after the armature has been moved so that it is adjacent the magnet of the contactor, the current draw of the winding naturally decreases substantially to a low "sealed" current level which is required to keep the contactor in the closed position thereof but which can be maintained indefinitely without burnout. This is a natural phenomenon of AC contactors which permits the same winding to be used as both a pickup winding and a holding winding so that mechanical switching components are not necessary. It has, however, heretofore been impossible to provide electrical delay features in AC contactors of this type using capacitors since capacitors are only operable with DC voltage.

The instant invention provides an AC contactor which exhibits delay characteristics on dropout and which is therefore effective for use in the computer industry and other industries in applications where delay-on-dropout is necessary. Contactors of the type with which the instant invention are concerned comprise a contactor body made of an electrical insulating material, first and second fixed contacts mounted on the body, a fixed magnetically responsive element on the body, a movable magnetically responsive element on the body biased to a first position of spaced disengagement from the fixed element but movable to a second position of engagement therewith, and first and second movable contacts mounted in electrically insulated relation on the movable magnetic element for movement therewith between a position wherein they are in engagement with the first and second fixed contacts, respectively, and a position wherein they are in spaced disengagement from the fixed contacts. The contactor of the instant invention further comprises an AC pickup winding mounted on one of the magnetically responsive elements for effecting the magnetic energization thereof upon electrical energization of the pickup winding with an AC power source, and a DC holding winding mounted on one of the magnetically responsive elements for maintaining the movable element in the second position thereof. The contactor also comprises a capacitor electrically connected across the holding winding and a rectifier electrically connected across the holding winding in parallel with the capacitor for supplying DC power to the holding winding and the capacitor from the AC power source. Accordingly, the contactor is completely energizable from the AC power source and uses AC power for the pickup winding thereof but includes a rectifier for providing DC power to the holding winding thereof. As a result, the advantages of AC contactors and DC contactors are combined in a single contactor which uses both AC and DC power for the operation thereof but which is energizable from an AC power source.

In the operation of the contactor, the AC pickup winding thereof initially draws a substantial amount of current until the movable magnetically responsive element thereof is moved to a position of engagement with the fixed magnetically responsive element whereupon the power consumption of the AC pickup winding is substantially reduced, similar to the winding of a conventional AC contactor. As a result, the AC pickup winding can remain energized without burning out, although it is not required for maintaining the contacts in the closed positions thereof. The DC holding winding, on the other hand, is operative for maintaining the contactor in the closed position thereof; and since it operates on DC power, a dropout delay can be provided utilizing a capacitor. As a result, it is seen that the contactor of the instant invention combines the advantage of AC contactors with those of DC contactors to provide a reliable contactor having a delay-on-dropout feature. Further, although the invention is illustrated and described as a contactor, the embodiment thereof in solenoid relays, etc., is also contemplated.

Accordingly, it is a primary object of the instant invention to provide a reliable magnetically operable AC switching device having a delay-on-dropout feature.

Another object of the instant invention is to provide a reliable contactor having a delay-on-dropout feature which is energizable from an AC power source.

A still further object of the instant invention is to provide a switch for use with computer equipment to permit the safe shutdown thereof under power failure or severe brownout conditions.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
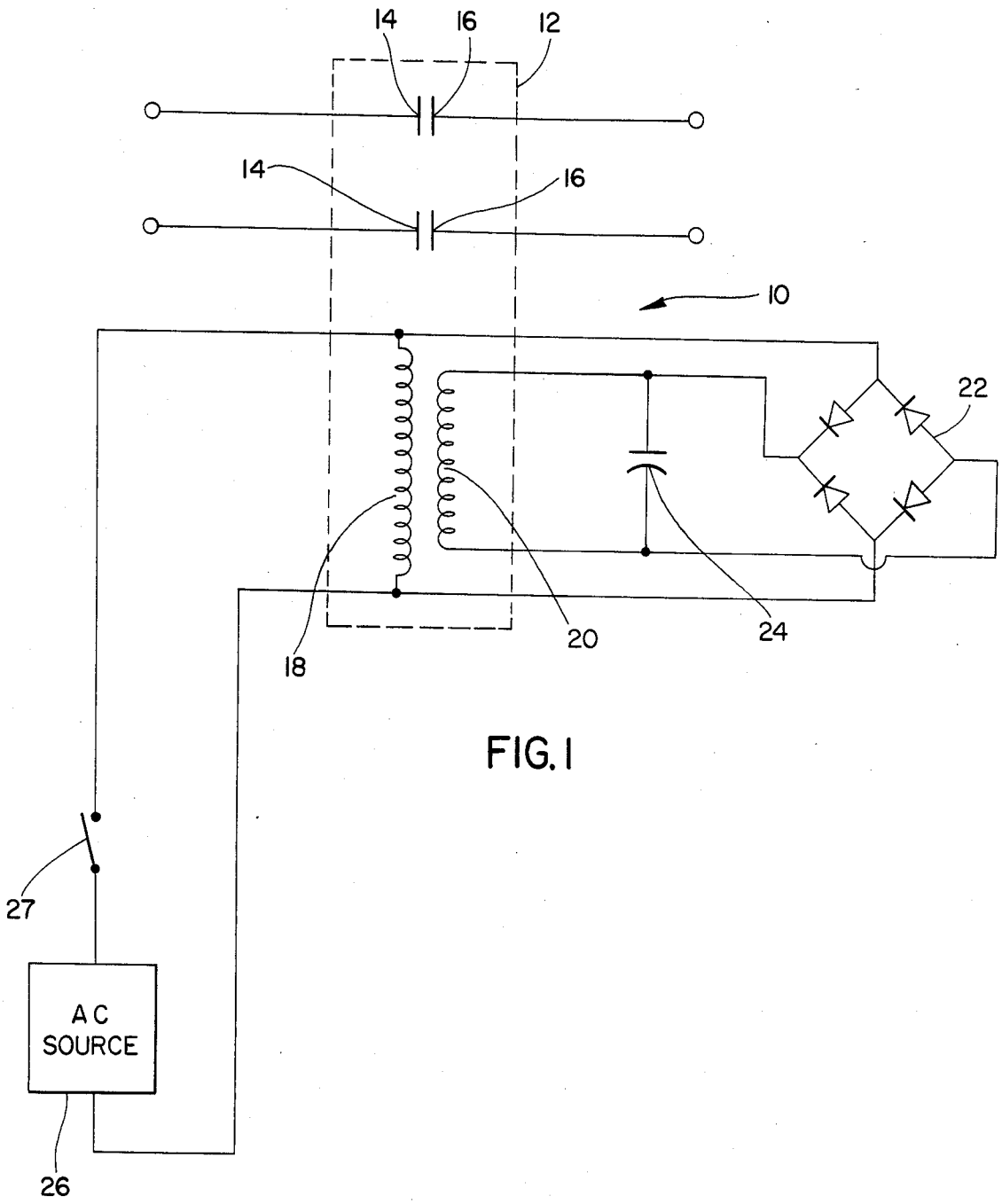
FIG. 1 is a schematic diagram of the contactor circuitry of the instant invention.

Referring now to the drawings, the electrical contactor circuitry of the instant invention is schematically illustrated in FIG. 1 and generally indicated at 10. The contactor circuitry 10 is used in combination with a contactor unit 12 which comprises conventional contactor components such as a contactor body and fixed and movable magnetically responsive elements (shown in FIGS. 2 and 3) which will hereinafter be more fully described. The contactor unit 12 also comprises fixed and movable contacts 14 and 16, an AC pickup winding 18, and a DC holding winding 20 which will also hereinafter be more fully described. The contactor circuitry 10 is electrically connected to the contactor unit 12 and comprises a rectifier 22 and a capacitor 24. The pickup winding 18 and the rectifier 22 are electrically connected to an AC power source 26 for energization with AC power through any suitable control device, such as switch 27, and the holding winding 20 and the capacitor 24 are electrically connected in parallel to the rectifier 22 for energization with DC power. Upon energization of the contactor circuitry 10 with the AC power source 26, the AC pickup winding 18 functions to move the movable contacts 16 into engagement with the fixed contacts 14, and the DC holding winding 20 which is energized through the rectifier 22 functions to maintain the movable contacts 16 in engagement with the fixed contacts 14. The capacitor 24 is also energized through the rectifier 22 and is connected thereto in parallel with the winding 20; and accordingly, in the event of a power failure, the capacitor 24 discharges energy stored therein to maintain the energization of the holding winding 20 for a fraction of a second after the occurrence of the power failure, whereby a delay is provided in the separation of the movable contacts 16 from the fixed contacts 14.

Figure 2:
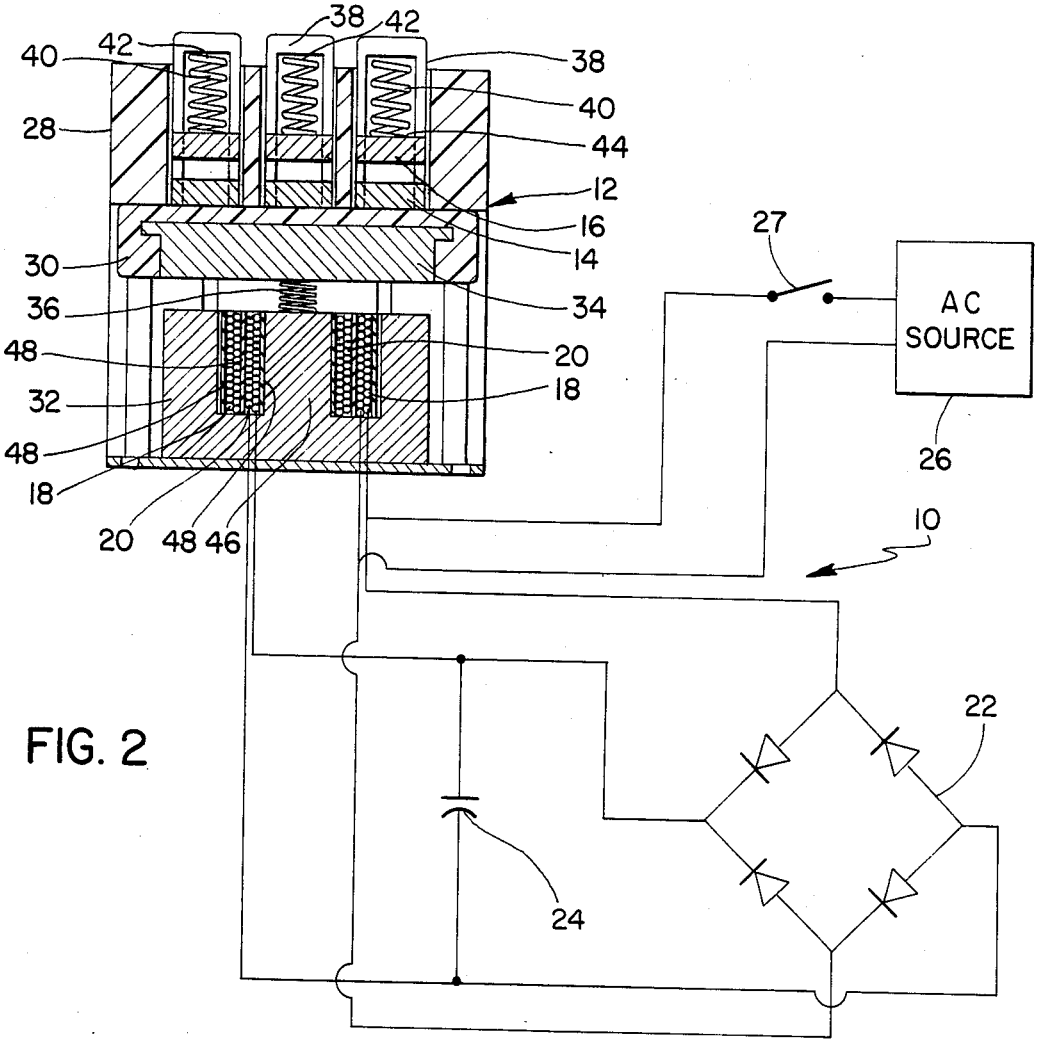
FIG. 2 is a sectional view of a contactor in the open position thereof with the circuitry of the contactor schematically illustrated.
Figure 3:
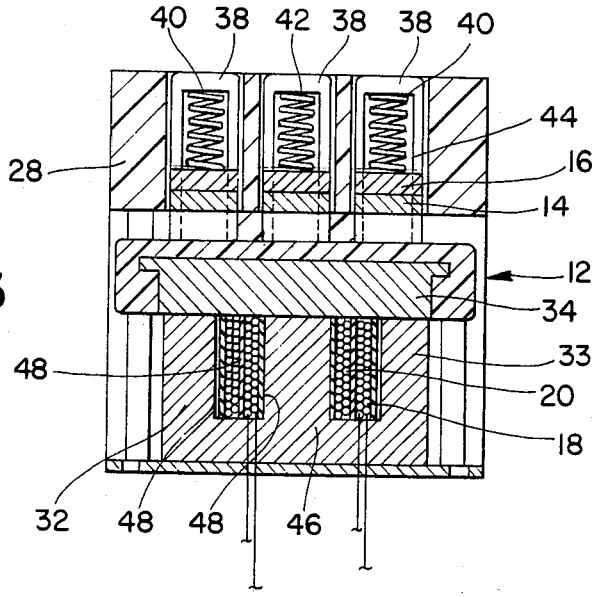
FIG. 3 is a sectional view of the contactor in the closed position thereof.

Referring now to FIGS. 2 and 3, the contactor is shown in FIG. 2 with a portion of the circuitry thereof schematically illustrated and with the contactor unit 12 thereof structurally represented in the open position thereof, whereas the contactor unit 12 per se is illustrated in the closed position thereof in FIG. 3. As mentioned, the contactor unit 12 comprises the fixed and movable contacts 14 and 16, respectively, the AC pickup winding 18, and the DC holding winding 20. The contactor unit 12 further comprises a contactor body 28 in which a carrier 30 is mounted, both the body 28 and the carrier 30 preferably being made of an electrical insulating material, such as a phenolic. Also included in the contactor unit 12 is a fixed magnetically responsive element or magnet 32 mounted in the body 28 and a movable magnetically responsive element or armature 34 is attached to the carrier 30 for movement therewith in the body 28, both the magnet 32 and the armature being made of a ferrous material. The armature 34 is movable between a first position of spaced disengagement from the magnet 32 illustrated in FIG. 2 and a second position of engagement therewith illustrated in FIG. 3, the armature 34 being biased to the first or disengaged position thereof with a return spring 36. In the contactor unit 12 as herein embodied, a plurality of rectangular frame elements 38 integrally extend from the carrier 30 and contain contact springs 40 which are secured at the ends thereof to the frame elements 38 as at 42. The movable contacts 16 are slidably received in the frame elements 38 and are secured to the springs 40 at at 44. Accordingly, when the armature 34 is moved to its second position of engagement with the magnet 32, the frame elements 38, the springs 40, and the movable contacts 16 are also moved generally towards the magnet 32. The fixed contacts 14 are mounted in the body 28 so that they are in spaced relation with the movable contacts 16 when the armature 34 is in its first or disengaged position and so that the fixed contacts 14 are in engagement with the movable contacts 16 when the armature 34 is in its second position, i.e., its position of engagement with the magnet 32. As will be seen from FIG. 2, the distance between the fixed and movable contacts 14 and 16, respectively, is less than the distance between the armature 34 and the magnet 32 when the armature 34 is in its first position of spaced disengagement from the magnet 32. Accordingly, when the armature 34 is moved into engagement with the magnet 32, the springs 40 are compressed to provide pressurized engagement of the movable contacts 16 with the fixed contacts 14. The magnet 32, which is mounted in the contactor body 28, may be of E-shaped configuration, and the pickup and holding windings 18 and 20, respectively, are preferably coaxially wound around the center leg 46 of the E-magnet 32. Insulation 48 electrically insulates the windings 18 and 20 from each other and from the E-magnet 32. The AC pickup winding 18 is electrically connected to the AC power source 26 through the switch 27 as hereinabove set forth, and the DC holding winding 20 is electrically connected to the rectifier 22 and to the capacitor 24, so that the capacitor 24 and the rectifier 22 are in parallel relation, and the rectifier 22 is electrically connected to the AC power source 26 through the switch 27.

In operation, the switch 27 is closed so that both the AC pickup winding 18 and the DC holding winding 20 are energized. Upon initial energization of the contactor circuit 10, there is a relatively high "inrush" current flow through the AC pickup winding 18, because the impedance in the winding 18 is relatively low when the armature 34 is in spaced relation to the E-magnet 32. As a result of this "inrush" current, a relatively high electromagnetic attraction is produced between the E-magnet 32 and the armature 34 whereby the armature 34 is drawn towards the E-magnet 32, along with the carrier 30, the frame 38, the springs 40 and the movable contacts 16, compressing the spring 36 and moving the movable contacts 16 into engagement with the fixed contacts 14. After the armature 34 has been moved into engagement with the E-magnet 32, the impedance in the pickup winding 18 is increased substantially by the interference of the armature 34 with the magnetic flux lines around the E-magnet 32 so that the current flow through the pickup winding 18 drops to a low "sealed current" level which can be maintained indefinitely without causing burnout of the AC pickup winding 18. Once the armature 34 has been moved into engagement with the E-magnet 32, the DC holding winding 20 maintains the armature 34 in engagement therewith as long as the DC holding winding 20 remains energized. In this connection, it is preferable that the strength of the magnetic field produced by the DC holding winding 20 be of substantially greater magnitude than the peak magnitude of the magnetic field produced by the AC pickup winding 18 when the armature 34 is in its second position wherein it is in engagement with the E-magnet 32. This is important because of the fact that the magnetic field produced by the AC pickup winding 18 is cyclical and therefore has both positive and negative peak values. As a result, when the armature 34 is in its position of engagement with the E-magnet 32, the field produced by the DC winding 20 is preferably always substantially greater than the field produced by the AC winding 18 so that the sum of the fields produced by the two windings is always sufficient to counteract the force of springs 36 and 40. In this connection, the relation between the magnitudes of the two magnetic fields is particularly important during portions of the AC cycle when the two fields are of opposite polarity and therefore tend to counteract each other. During these periods, it is most important that the field produced by the DC winding 20 is sufficient to counteract both the field produced by the AC winding 18 and the force of the springs 36 and 40 in order to assure that the contacts 14 and 16 are maintained in engagement. Thus, once the armature 34 has been moved into engagement with the E-magnet 32, the DC holding winding 20 maintains it in positive engagement therewith until the AC source is interrupted. When this occurs, however, the energy stored in the capacitor 24 is discharged to maintain the holding winding 20 energized for an instant so that the movable contacts 16 are maintained in engagement with the fixed contacts 14 for an instant to permit safe shutdown of equipment energized through the contacts 14 and 16.

It is seen, therefore, that the instant invention provides an effective magnetically operated AC switching device with a delay-on-dropout feature which provides sufficient time for safe shutdown of equipment energized therethrough. The contactor of the instant invention functions with the reliability of a conventional AC contactor but nevertheless has a delay-on-dropout feature which is provided through the use of a capacitor. Accordingly, the contactor is reliable for a variety of applications and is operable for permitting safe shutdown of equipment energized through the contactor because of the delay-on-dropout feature. Accordingly, it is seen that the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A magnetically operable AC switching device comprising:

a. a body made of an electrical insulating material;

b. a fixed contact on said body;

c. a fixed magnetically responsive element on said body;

d. a movable magnetically responsive element on said body biased to a first position of spaced disengagement from said fixed magnetically responsive element but movable to a second position of engagement therewith;

e. a movable contact mounted in electrically insulated relation on said movable element for movement therewith so that it is in engagement with said fixed contact in one of said movable element positions and in spaced disengagement therefrom in the other of said movable element positions;

f. an AC pickup winding mounted on one of said magnetically responsive elements for effecting the magnetic energization thereof upon the electrical energization of said pickup winding with an AC power source for moving said movable element from said first to said second position thereof;

g. a DC holding winding mounted on one of said magnetically responsive elements for maintaining said movable element in said second position thereof, said pickup winding and said holding winding being constructed so that when said fixed and movable elements are in engagement, the magnetic attraction therebetween produced by said holding winding is greater than the magnetic attraction therebetween produced by said pickup winding throughout the cycle of the AC power connected to said pickup winding to permit said pickup winding to remain energized when said fixed and movable elements are in engagement;

h. capacitor means electrically connected across said holding winding; and i. rectifier means electrically connected across said holding winding in parallel with said capacitor means for supplying DC power to said holding winding and to said capacitor means upon connection of said rectifier means to said AC power source, whereby the energy stored in said capacitor means delays the movement of said movable magnetically responsive element from said second position to said first position upon the deenergization of said AC power source.

2. In the device of claim 1, said pickup and holding windings both being on the same magnetically responsive element.

3. In the device of claim 1, said pickup and holding windings both being on said fixed magnetically responsive element.

4. In the device of claim 1, said rectifier means and said pickup winding being electrically interconnected for energization from a single AC power source.

5. The device of claim 1 further characterized as comprising first and second fixed contacts mounted on said body and first and second movable contacts mounted in electrically insulated relation on said movable element so that they are in engagement with said first and second fixed contacts, respectively, in one of said movable element positions and in spaced disengagement therefrom in the other of said movable element positions.

6. In the device of claim 1, said pickup winding and said rectifier means being interconnected so that said pickup winding is energized with said AC power source whenever said rectifier means is energized with said AC power source.

* * * * *